United States Patent [19]

Gerber

[11] 4,195,214

[45] Mar. 25, 1980

[54] APPARATUS FOR INDUCTION HEATING OF METAL PLATES WITH HOLES

[75] Inventor: Howard L. Gerber, Park Forest, Ill.

[73] Assignee: The Continental Group, Inc., New York, N.Y.

[21] Appl. No.: 869,770

[22] Filed: Jan. 16, 1978

Related U.S. Application Data

[63] Continuation-in-part of Ser. No. 700,494, Jun. 28, 1976, Pat. No. 4,104,498.

[51] Int. Cl.[2] ..... H05B 5/18

[52] U.S. Cl. ..... 219/10.79; 219/10.49 R; 219/10.53; 219/10.57; 336/83

[58] Field of Search ..... 219/10.79, 10.53, 10.49, 219/10.41, 10.57, 7.5, 10.43; 336/73, 83, 84 M, 210, 223

[56] References Cited

U.S. PATENT DOCUMENTS

| | | | |
|---|---|---|---|
| 2,314,865 | 3/1943 | Bierwirth | 219/10.79 |
| 2,386,819 | 10/1945 | Sherman | 219/10.79 |
| 2,402,508 | 6/1946 | Strickland | 219/10.79 |
| 2,485,843 | 10/1949 | Pinkney | 219/10.79 |
| 2,493,771 | 1/1950 | Marquardt et al. | 219/10.79 |
| 3,808,074 | 4/1974 | Smith et al. | 219/10.43 |
| 4,017,701 | 4/1977 | Mittelmann | 219/10.79 |

FOREIGN PATENT DOCUMENTS

| | | | |
|---|---|---|---|
| 525911 | 7/1954 | Belgium | 219/10.79 |

*Primary Examiner*—Bruce A. Reynolds
*Assistant Examiner*—Philip H. Leung
*Attorney, Agent, or Firm*—Charles E. Brown

[57] ABSTRACT

There has been developed end units for cans of the easy opening type wherein end panels of the end units are provided with patterns of holes to facilitate the dispensing of a product. The holes are closed by means of strips, preferably formed of plastics material, overlying the holes and being bonded to the metal of the end units adjacent the holes. It is preferred that the bonding of the strips be effected by heat. A special induction heater has been constructed which induces into the metal of the area to where the strips are to be bonded electrical energy which results in the heating of the metal. The heater is particularly constructed so as to compensate for the holes in the metal of the end units and thus a uniform heating of the metal over the area to which the strip is to be applied can be effected.

17 Claims, 18 Drawing Figures

FIG. 8
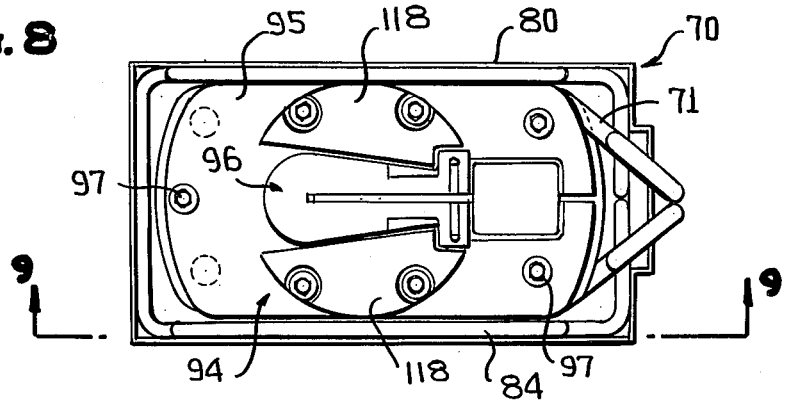
FIG.9
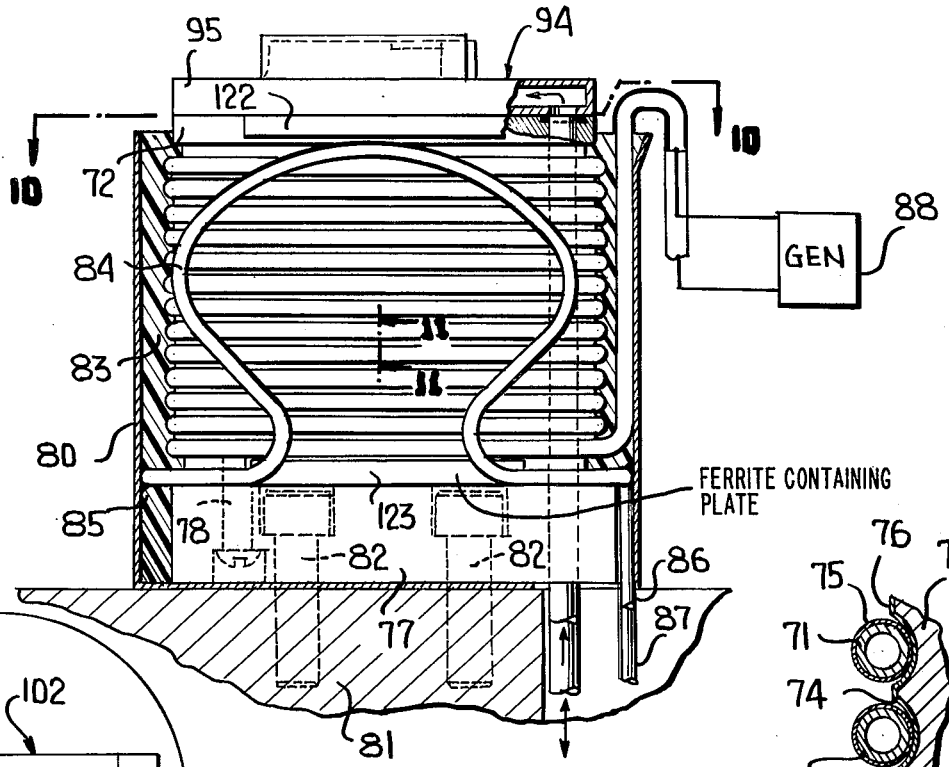
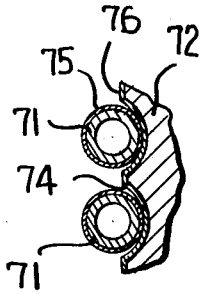
FIG.11
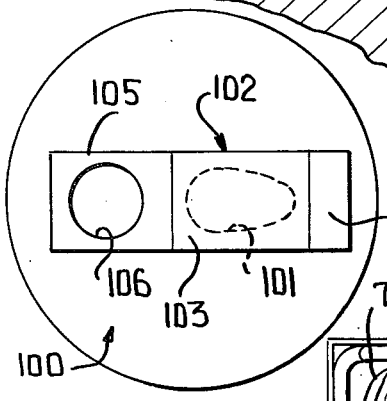
FIG.18
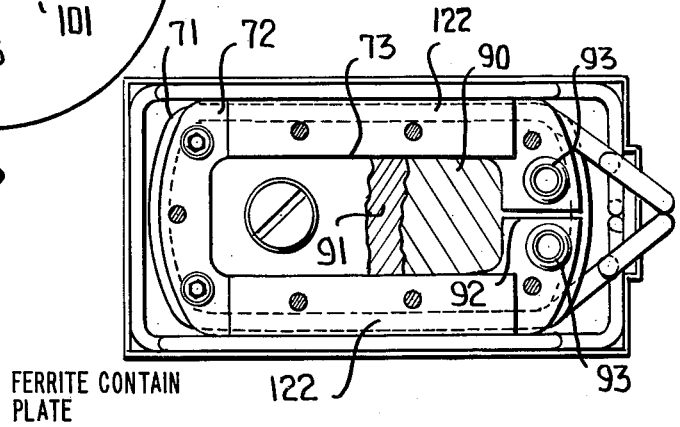
FIG.10

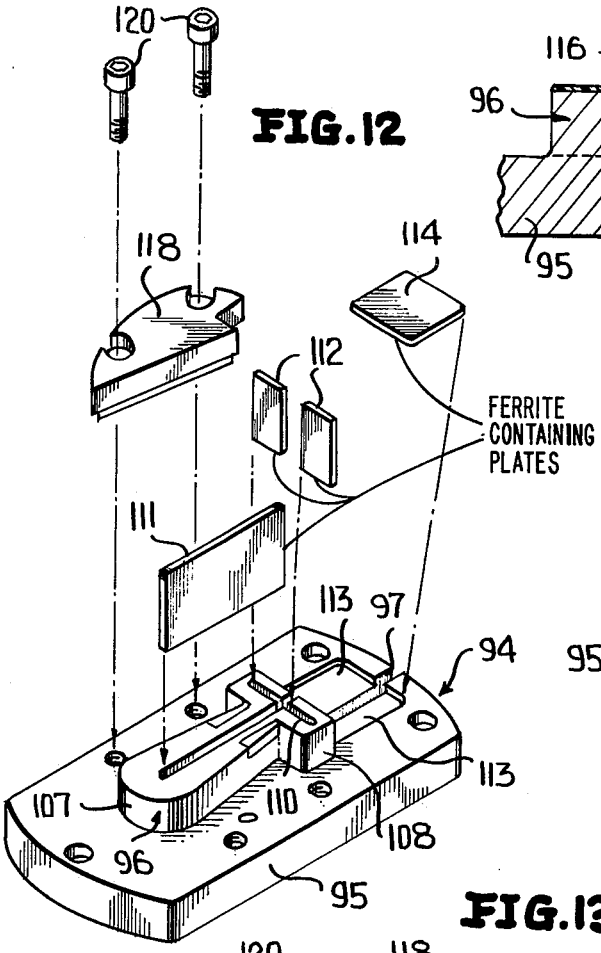
FIG.12
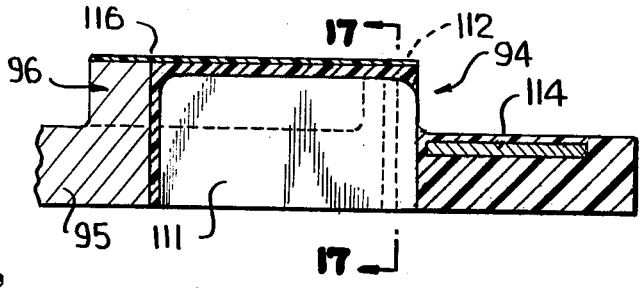
FIG.16
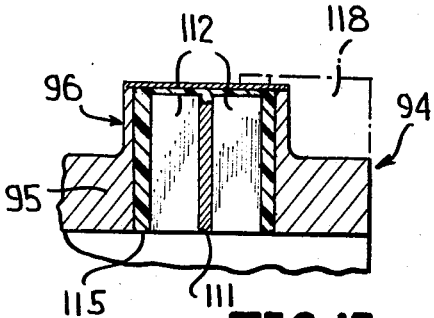
FIG.15
FIG.13
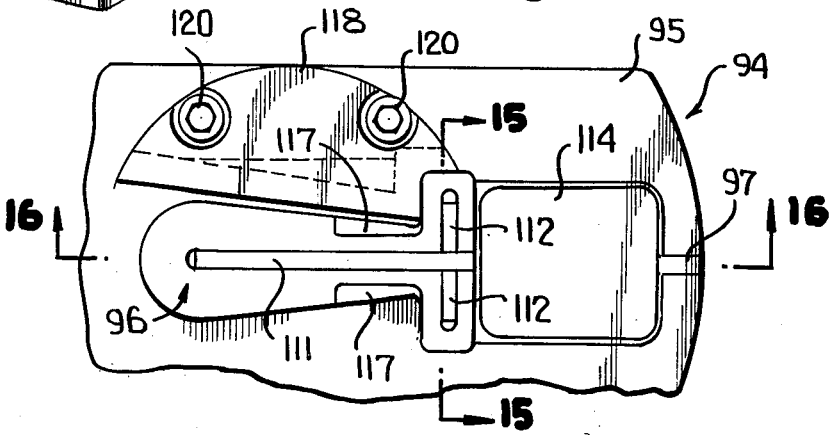
FIG.14
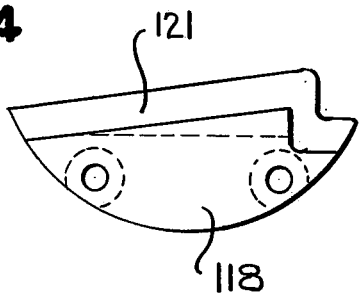
FIG.17
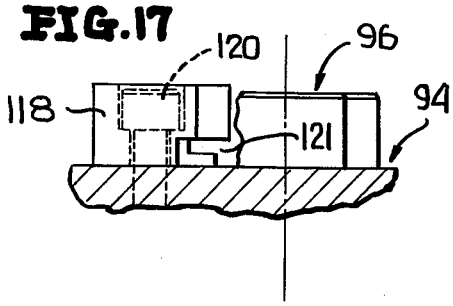

APPARATUS FOR INDUCTION HEATING OF METAL PLATES WITH HOLES

This application is a continuation-in-part of my copending application Ser. No. 700,494, filed June 28, 1976, now U.S. Pat. No. 4,104,498.

This invention relates in general to new and useful improvements in induction heating, and more particularly to a heater specifically constructed for the uniform heating of metal plates having patterns of holes therein and the method of utilizing such a heater.

There has been developed an easy opening end unit for cans wherein the dispensing opening is in the form of a plurality of holes arranged in a predetermined pattern. These holes are initially closed by a strip of plastics material which is bonded to the face of the end panel surrounding the holes.

In the past there has been developed induction heaters for heating various portions of containers and closures therefor. However, the heating of the perforated metal sheet or plate posed an entirely different problem. It will be readily apparent that the tendency of a heater of the induction heating type is to generally uniformly heat a surface. It is not, however, desired to heat the "holes". Further, it is desired to heat only that surface of the sheet material of the end unit to which the sealing strip is to be bonded. Therefore, in accordance with this invention, there has been developed a special induction heater and a method of utilizing the same.

One of the principal features of the invention is the heater per se and more particularly the nosepiece of the heater and the manner in which high frequency electrical energy is transmitted into the nosepiece. In accordance with this invention, the electrical energy is concentrated in the nosepiece from a single turn secondary winding of a transformer, which winding is in the form of a tubular body having an axially extending slot extending the full height thereof. The slot is in the form of an air gap with the induced current travelling mainly in the slot up to the nosepiece. The nosepiece, in turn, is provided with a slot aligned with the slot in the secondary so as to receive current therefrom.

In accordance with this invention, current is primarily directed into the nosepiece through the slot therein, which slot is filled with a ferrite filler compound. Transverse current flow in the nosepiece to opposite sides of the slot in the nosepiece is determined by the width of the slot. Accordingly, the width of the slot may be varied to control the flow of current.

In a like manner, it has been found that concentration of current in certain portions of the face of the nosepiece can be controlled by forming recesses in the face. In addition, it has been found that transverse flow of current towards peripheral portions of the nosepiece can be effected by intersecting the slot in the nosepiece with other slots extending transversely of the main slot.

Concentrated flow of electrical energy to the nosepiece is also effected by means of a ferrite core which is positioned within the single turn secondary or core form.

Another feature of the invention is the forming of the periphery of the single turn secondary core form with a plurality of fins which define between them slots in which the multi-turn primary winding is seated. The relationship of the primary to the secondary is such that the current induced into the secondary is concentrated primarily along the slot with a smaller amount of induced current flowing on the inside of the coil form with the ferrite core providing a large inductance thereby forcing the major portion of the induced current on the inside of the coil form to the nosepiece.

In accordance with this invention, the particular pattern of holes in the area of the end unit which is to be heated is determined, after which the nosepiece of the heater is specifically designed to provide for a uniform heating of the metal over the predetermined area. Further, the metal, by skin effect, is heated primarily on the surface thereof opposing the heater. Immediately after the end unit has been heated, the sealing strip is applied thereto in a known manner so as to effect the necessary sealing of the sealing strip to the heated surface of the end unit.

In accordance with one embodiment of the invention, the primary coil is shielded by means of a shield telescoped thereover and the shield is preferably cooled by means of a coolant coil bonded to the inner surface thereof.

It is also desirable to cool the nosepiece, and accordingly the coil form is provided with coolant passages therethrough on opposite sides of the axial slot formed therein with the coolant passages opening into the interior of the nosepiece on opposite sides of the slot formed in the nosepiece.

Another feature of the invention is the positioning of ferrite or ferrite-epoxy pieces between the nosepiece and the coil form to reduce the reluctance of the magnet path between the nosepiece and the core. Similar ferrite or ferrite containing pieces may be positioned between the underside of the coil form and a supporting base for both the coil form and the core.

A further and more specific feature of the invention is the provision of a nosepiece suitable for bonding a tear tape to a metal end unit wherein the tear tape has areas of greater bonding power and lesser bonding power and wherein there is a concentration of heat in the metal in alignment with the areas of greater bonding power.

A further feature of the invention is to provide a nosepiece suitable for heating a metal end unit having a teardrop shaped single opening therein normally closed by a tear strip which is bonded to the container unit surrounding the opening and which tear strip is further permanently secured to the container unit adjacent the tear strip.

With the above and other objects in view that will hereinafter appear, the nature of the invention will be more clearly understood by reference to the following detailed description, the appended claimed subject matter, and the several views illustrated in the accompanying drawings.

In the drawings:

FIG. 8 is a plan view of still another flux concentrator or heater formed in accordance with this invention.

FIG. 9 is a fragmentary vertical sectional view taken along the line 9—9 of FIG. 8 and shows further the details of the flux concentrator.

FIG. 10 is a horizontal sectional view taken along the line 10—10 of FIG. 9 and shows more specifically the construction of the coil form, the primary coil carried thereby, the surrounding shield and a mounting base.

FIG. 11 is an enlarged fragmentary transverse sectional view taken generally along the line 11—11 of FIG. 9 and shows more specifically the relationship of the windings of the primary coil with respect to the coil form.

FIG. 12 is an enlarged exploded perspective view of the modified form of nosepiece carried by the flux concentrator of FIG. 8.

FIG. 13 is an enlarged fragmentary plan view of the nosepiece of FIG. 12 and shows the constructional details thereof.

FIG. 14 is an enlarged fragmentary bottom view of one of the insulator blocks of the nosepiece.

FIG. 15 is an enlarged fragmentary transverse sectional view taken along the line 15—15 of FIG. 13 and shows the specific mounting of the ferrite or ferrite containing plates in the nosepiece.

FIG. 16 is an enlarged fragmentary longitudinal sectional view taken along the line 16—16 of FIG. 13.

FIG. 17 is an enlarged fragmentary transverse sectional view taken generally along the line 17—17 of FIG. 16 and shows the mounting and relationship of one of the insulator blocks with respect to other portions of the nosepiece.

FIG. 18 is a fragmentary plan view of a container end unit having a tear strip or sealing strip which is applied utilizing the nosepiece of FIG. 12.

Figures 1, 2, 3:
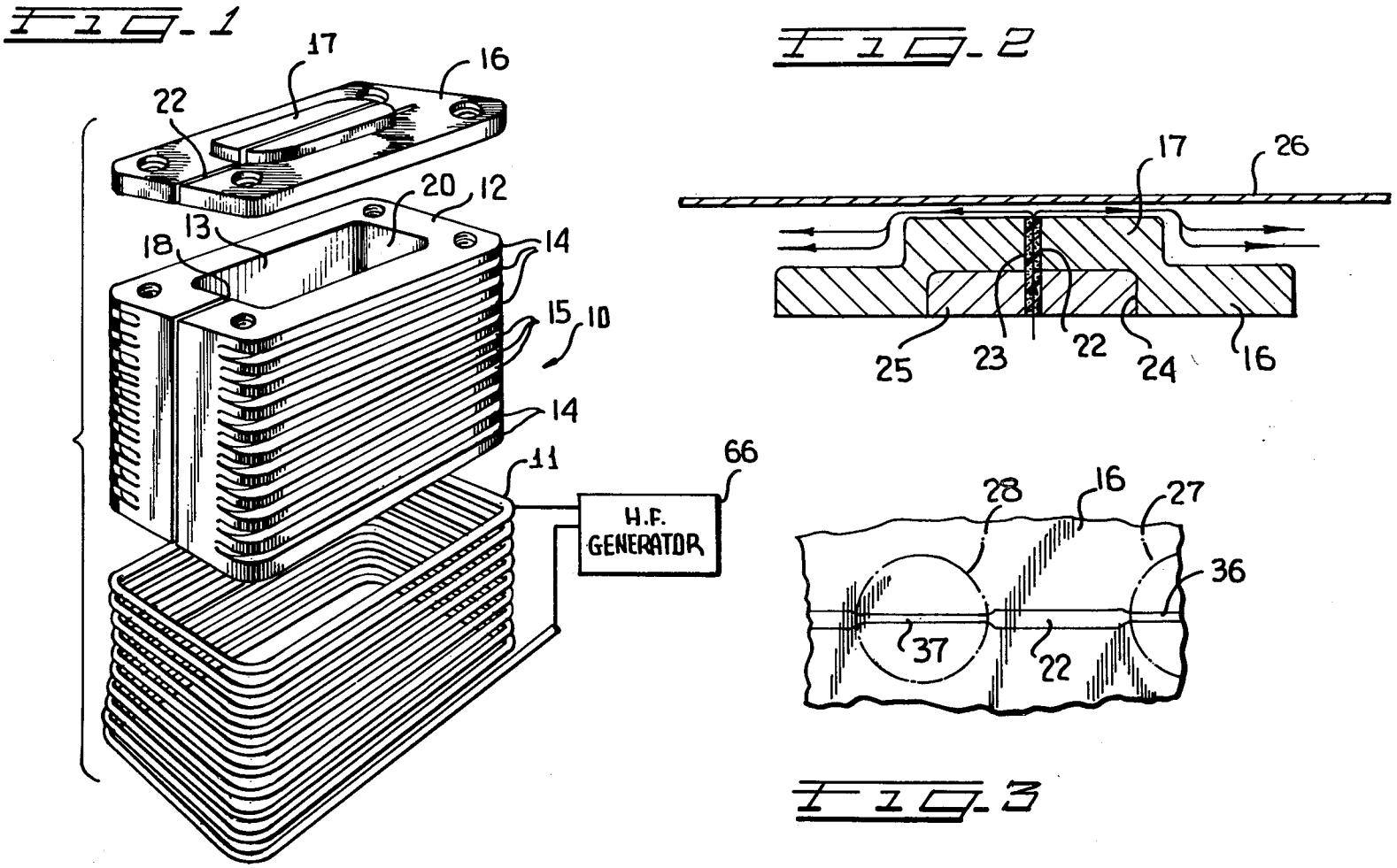
FIG. 1 is an exploded perspective view of the flux concentrator or heater formed in accordance with this invention.
FIG. 2 is an enlarged fragmentary transverse sectional view through the nosepiece of FIG. 1 and shows the magnetic flux path therefrom in conjunction with a metal plate being heated.
FIG. 3 is a fragmentary plan view of the nosepiece on a large scale showing the variation in the width of the slot in the nosepiece in accordance with the arrangement of holes in the metal sheet to be heated.

Referring now to the drawings in detail, it will be seen that the flux concentrator or heater formed in accordance with the invention is generally identified by the numeral 10 and is illustrated in an exploded condition in FIG. 1. The heater 10 includes a transformer in the form of a multi-turn primary coil 11 which is preferably formed of tubing, and a secondary single-turn winding in the form of a tubular coil form 12. In the preferred embodiment of the coil form 12, it is of a rectangular outline and has a rectangular opening 13 extending vertically therethrough. The height of the coil form 12 is determined by the size and number of turns in the primary coil 11.

At this time it is pointed out that the opposite sides of the coil form 12 are provided with a plurality of fins 14 which have defined therebetween grooves 15 into which the windings of the coil 11 are recessed. It will thus be seen that the relationship between the coil form and the windings of the coil is such so as to provide a large coupling area. Naturally, the increase in the area where the magnetic field is applied increases the induced current. In addition, because the induced current is spread over a large area, the coil form losses are reduced.

It is to be understood that when the primary coil 11 and the secondary coil form 12 are assembled, and the ends of the primary coil 11 are connected to a HF generator, electrical current will be induced into the coil form. In order that the electrical energy induced into the coil form 12 may be directed into a preselected area of a workpiece, the heater 10 also includes a nosepiece 16. The nosepiece 16 is preferably in the form of a conductive plate, such as copper, and is provided with a raised portion 17. The nosepiece is mechanically and electrically secured to the upper face of the coil form 12 by means of suitable fasteners (not shown).

In order that the current induced into the coil form 12 may be forced to the nosepiece, the coil form is provided with an axial slot 18 which extends through the thickness thereof for the full height thereof. It will be readily apparent that all current flowing in the coil form 12 must produce closed loops and the induced current in the coil form 12 encountering the slot 18 will travel in any of three ways: up, down or horizontally along the inside surface. The determining factor for the direction of current flow is the inductance rather than the resistance of the assembly. Accordingly, the operating frequency is made high enough so that current opposition is in the form of an inductive reactance as opposed to a resistance. Therefore, since it is desirable to have the current go to the nosepiece, the nosepiece must have the lowest inductance. In order to enhance this flow, the slot must be wide enough to present flow series inductance with that of the nosepiece.

A ferrite core 20 is positioned within the opening 13 in the coil form 12 and provides the inside surface of the coil form with a high inductance. The core provides the means for carrying the magnetic flux to the nosepiece. There is a large current in the nosepiece which dictates a large magnetic flux. For planar surfaces, the magnetic intensity is equal to the current per unit width. The ferrite core facilitates the transport of magnetic flux up to the nosepiece from the inside of the coil form and, therefore must be capable of handling the flux density at the operating frequency.

It is to be understood that the nosepiece 16 carries the induced current toward the load and is essentially a low inductance short circuit. It is preferably constructed from copper plate and in the preferred embodiment of the invention has a thickness of 0.2 inch. Further, the nosepiece 16 has a longitudinal slot 22 extending the full depth thereof with the slot extending substantially entirely across the nosepiece 16 and entirely across the raised portion 17. In the preferred embodiment of the invention, the slot 22 has a width of 0.03 inch. As is best shown in FIG. 2, the slot 22 is filled with a suitable filler 23 which includes a ferrite. Preferably the filler 23 is a ferrite-epoxy compound. The ferrite-epoxy compound facilitates the transport of magnetic flux from the core to the load.

With particular reference to FIG. 2, it will be seen that the nosepiece 16 has the upstanding portion 17 thereof formed by stamping. When the nosepiece is so formed, a recess 24 is formed in the underside of the nosepiece. This recess is filled with a further ferrite core 25 which has a continuation of the slot 22 formed therein and wherein the filler 23 for the slot 22 extends down into the core 25.

As will be apparent from FIG. 2, when there is associated with the nosepiece 16 a plate or sheet 26 which is to be locally heated in accordance with the configuration of the raised portion 17, flux path is up through the ferrite material in the slot 22 and in opposite directions toward the periphery of the nosepiece. This is clearly indicated by arrows.

Figure 6:
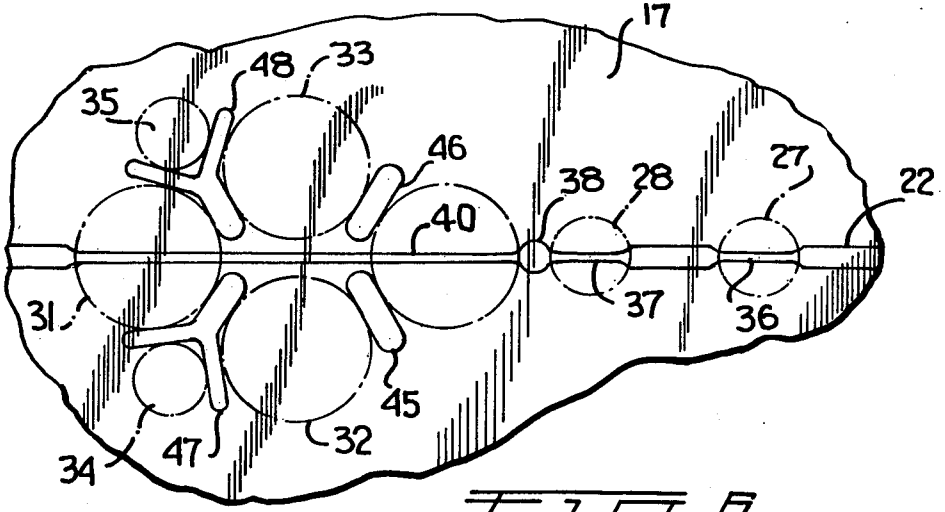
FIG. 6 is an enlarged fragmentary plan view of a portion of the nosepiece which is to be aligned with an end unit for the purpose of heating the face thereof to effect bonding of the sealing strip to the end unit and has superimposed thereon in phantom lines the arrangement of holes in the end unit.

If the portions of the plate 26 to be heated were free of perforations, etc., no further modification of the nosepiece 16 would be required. However, the plate 26, which is generally an end panel of an end unit for a container, may be provided with a pattern of holes or perforations. As illustrated in FIG. 6, these holes or perforations may include two smaller holes 27, 28 arranged in alignment, followed by two larger holes 30, 31 also in longitudinal alignment, but more widely spaced from one another. Disposed in transverse offset aligned relation between the holes 30, 31 is a pair of holes 32, 33. In addition, in diagonally offset relation transversely outwardly of the holes 31, 32 is a hole 34. A similar hole 35 is disposed in diagonally offset relation between the holes 31, 33. In order that there may be a uniform heating of the plate 26, notwithstanding the existence of the numerous holes therein, modifications are required in the nosepiece 16 in the area of the raised portion 17. First of all, it is to be understood that the current flow up through the slot 22 will be dependent primarily on the ability of the ferrite within the slot 22 to conduct the electrical current from the coil form 12 and the ferrite core 20. As is shown in enlarged detail in FIG. 3, where the holes 27, 28 are located in the plate 26 the slot 22 has been made of a reduced width, as at 36, 37, respectively. Thus the ferrite within the reduced width slot portions 36 and 37 has a lesser ability to accommodate current flow and therefore there is lesser current flow through the slot portions 36, 37 for flow transversely of the raised portion 17. Thus a generally uniform heating of the raised portion 17 in a transverse direction along its length is obtained. A like restrictive flow of electrical current could be obtained without reducing the width of the slot 22 by restricting the amount of ferrite placed in the slot.

When the holes are close together, such as the holes 28, 30, it may be desirable to increase the width of the slot 22 as at 38. Also, with the arrangement of the holes 30, 31, 32, 33, it is desirable that the slot be of a narrow width for the full extent of the holes as at 40.

As indicated above, the heating pattern on the load can be controlled by directing and proportioning the flux to various parts of the load. It is not necessary to couple flux to the open holes so, in that region, as described above, the central slot is narrow, producing a restricted amount of flux and less heating in those areas. For the region between the holes, the slot is wider, thereby producing more flux and a greater amount of heating.

Figure 4:
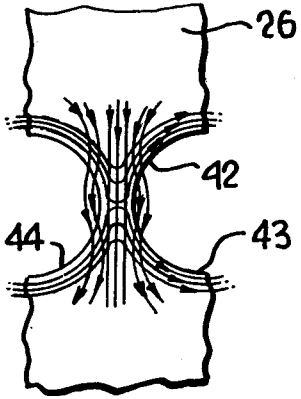
FIG. 4 is a schematic fragmentary view of the sheet which is to be heated by induction heating and shows the concentration of flux lines.

The hole arrangement effects the flux flow. The flux flow, as it emanates from the central slot, will follow the path of least reluctance. Therefore, if a flux path encounters two holes side-by-side, the flux will try to pass between the holes, as shown in FIG. 4. This produces a natural concentration of current between holes or in the web area. The flux lines going through the hole area, because of the air gap, are relatively low in intensity and bend toward the hole center. Most of the flux lines, however, are drawn to the area between the holes because of the higher permeability and corresponding lower reluctance path. Since the current is perpendicular, the current will also tend to concentrate in this area, thus causing overheating. It is believed that this is adequately shown by the flux lines in FIG. 4 passing through the web portion 42 extending between the adjacent holes 43, 44.

It has been found that this overconcentration of flux can be eliminated by milling grooves in the face of the raised portion 17. Such grooves are illustrated in FIG. 6 and include grooves 45 and 46 disposed between the holes 30, 32 on the one hand and the holes 30,33 on the other hand. In a like manner, generally Y-shaped grooves 47 and 48 are milled in the surface of the raised portion 17 between the holes 31, 32 and 34 on the one hand and the holes 31, 33 and 35 on the other hand.

Figure 5:
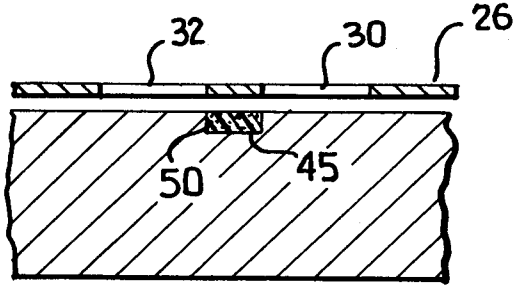
FIG. 5 is a fragmentary sectional view on a large scale through the nosepiece and shows the provision of a groove in the face thereof for the purpose of controlling current flow in the metal sheet in the area between two adjacent holes.

With particular reference to FIG. 5, it will be seen that it is desirable that the groove 45 be filled with a suitable filler 50 which may be epoxy. The purpose of the filler 50 is to prevent metal chippings from dropping in and filling the grooves.

It is to be understood that the increased gap, resulting from the milling of a groove in the face of the raised portion 17 in alignment with the area between the holes, now provides just above the milled groove an area with a higher air gap and reluctance. Thus, the increased gap is at that point where the flux naturally tends to concentrate so as to negate this concentration. It is pointed out here that it has been found that a groove depth on the order of 50 mils is satisfactory.

At this time it is pointed out that the configuration of the slot 22 and the grooves or slots milled in the face of the raised portion 17 is particularly designed for use with a steel workpiece. It is also to be understood that the configuration of the slot and the arrangement of the milled grooves is different for an aluminum sheet. This is due to the phenomenon where high frequency currents flow on the surface as opposed to penetrating the full thickness of the workpiece. Also, the surface of steel will conduct flux more readily than aluminum. For example, the relative permeability of steel at the high flux density involved in accordance with this invention will be on the order of 100 to 200 as opposed to a relative permeability of 1 for aluminum. As a result, the depth of the current flow along the skin of steel is much less than that of aluminum. Also, most of the flux will flow through the steel as opposed to through the air in the air gap between the workpiece and the nosepiece. At a working frequency on the order of 350 kHz, the penetration of the current in steel will be on the order of 1 mil whereas with the same frequency, the penetration of the current into aluminum will be on the order of $5\frac{1}{2}$ mils.

The net result of the foregoing is that there is more of a concentration of current in the area between the holes with steel than with aluminum. For this reason, you need a different pattern with aluminum than that described above with respect to FIG. 6 as used with steel.

Figure 7:
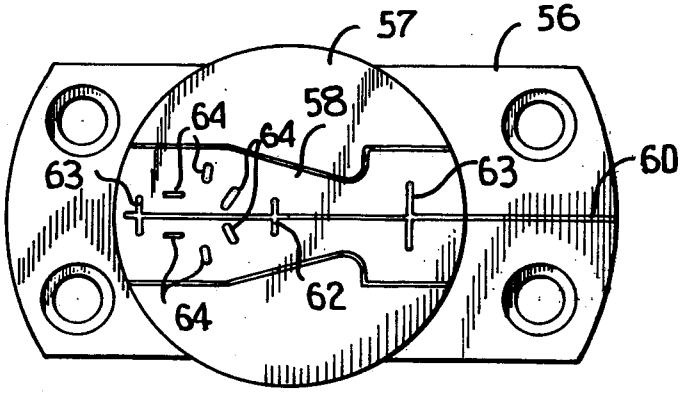
FIG. 7 is a plan view of an end piece particularly adapted for use in conjunction with an end unit formed of aluminum, the nosepiece being rotated approximately 180° from the nosepiece of FIG. 1 and being usable in lieu thereof.

Referring now to FIG. 7, it will be seen that there is illustrated a nosepiece 56 which is particularly adapted for use with aluminum. The nosepiece 56 includes a first raised portion 57 which is circular in outline and which is intended to be received within the recessed customary end unit for alignment purposes. The raised portion 57, in turn, has a raised portion 58 which corresponds to the raised or elevated portion 17 of the nosepiece 16.

The nosepiece 56 has a longitudinal slot 60 extending therethrough from one end thereof. However, in order to obtain proper flux flow, the raised portion 58 is provided with three slots 61, 62 and 63 which extend transversely of the slot 60. The slots 61, 62 and 63 extend the full depth of the nosepiece 56 and like the slot 60 are filled with a filler including a ferrite, the filler preferably being a ferrite-epoxy mixture as described above. It is to be understood that the slots 61, 62 and 63 are coordinated with the pattern of holes shown in FIG. 6.

In addition, the surface of the raised portion 58 is milled to provide a plurality of slots or grooves 64 which are arranged in a pattern so as to be between adjacent ones of the holes illustrated in FIG. 6.

At this time it is pointed out that nominally the temperature of the raised portion of the nosepiece is on the order of 400° F. The proximity between the nosepiece and the workpiece is one factor. The raised portion 17 is non-uniformly heated in that it is desired to heat essentially only those areas of the workpiece wherein there are no holes. There is no advantage in applying heat to the areas of the workpiece which are in the form of holes. The entire purpose of the device is to apply a uniform heat to the workpiece with the temperature being sufficient to effect the melting of the adhesive carried by the sealing strip (not shown) which is to be applied.

Referring once again to FIG. 1, it will be seen that a high frequency generator 66 is coupled to the coil 11. As indicated above, the invention has been successfully operated at a frequency on the order of 350 kHz and the HF generator 66 should have at least that capacity.

It is also pointed out here that there is a relatively great heat loss involved. Accordingly, a coolant may be circulated through the coil 11 in the customary manner. In a like manner, the coil form 12 and the nosepiece 16 may have suitable coolant openings therein. For example, a coolant cavity may be formed in the end portions of the coil form 12 and the nosepiece 16 opposite the slot 18.

It is pointed out here that although the holes in the workpiece 17 illustrated in the drawings are all circular, the invention is not so restricted to such a configuration of holes. The holes may be of various configurations. It is also to be understood that with various hole arrangements and hole configurations in sizes, it will be necessary to modify each nosepiece in accordance with the same so as to have varieties of slots and milled groove arrangements in order to compensate for the holes and to provide for uniform heating of the workpiece adjacent the holes.

Referring now to FIGS. 8–11, it will be seen that there is illustrated the details of a modified form of current concentrator or heater which is generally identified by the numeral 70. The current concentrator 70 is constructed very similar to the current concentrator 10 and includes a coil form 72 which is constructed similar to the coil form 12 in that it is generally rectangular in outline, as shown in FIG. 10, and has a rectangular opening 73 extending vertically therethrough. The coil form 72 is externally grooved and has positioned therein coils of a primary coil 71. The height of the coil form 72 is determined by the size and number of turns in the primary coil 71. As is clearly shown in FIG. 11, the external surface of the coil form 72 is provided with grooves 74 in which the individual coils or turns of the primary coil 71 are positioned. It is pointed out that the primary coil 71 is encased in a suitable insulating tubing 75 which may be formed of Teflon. In a like manner, the coil form 72 may have an external covering 76 so as to prevent electrical contact between the coil 71 and the coil form 72.

It is pointed out that the coil form 72 is secured to a base member 77 which is formed of conductive material and the coil form is secured to the base member 72 by means of suitable fasteners 78. The base member 77 is seated in the bottom of a container-like shield 80 and is secured to a supporting structure 81 by means of bolts 82.

The shield 80 extends substantially the full height of the coil form 72 and is spaced therefrom and from the primary coil 71. This space is filled by a suitable potting compound 83.

At this time it is pointed out that the shield 80, which is provided to prevent radio-frequency currents from being introduced in machine members, is cooled by means of a coolant coil 84. The coolant coil is secured to the inner surface of the shield 80 such as by soldering 85 and is of a configuration to provide effective cooling of the shield 80. The coolant coil 84 has leads 86, 87 to which means for circulating water or other coolant through the coil 84 may be connected.

It is to be understood that a high frequency generator 88 will be connected to the opposite ends of the primary coil 71, as is shown in FIG. 9.

At this time it is pointed out that a ferrite core 90 is positioned within the rectangular opening 73 in the coil form 72. While the core 90 may be seated directly on the base member 77, it is preferably seated on a thin resilient sheet 91 so as to be constantly resiliently urged upwardly for a reason to be described in further detail hereinafter.

It is pointed out here that the coil form 72, which functions as a secondary coil in conjunction with the primary coil 71, is of a split construction and one end thereof has an axial slot 92 extending the full height of the coil form. The slot 92 may be filled with a magnetically inert material such as a conventional plastics material such as Mylar.

If desired, the coil form 72 may be of a partially hollow construction so that it may be readily cooled by circulating a fluid therethrough. In any event, the coil form has extending therethrough a pair of copper tubes 93 which extend either entirely through the coil form or open into passages which, in turn, open through the top of the coil form.

The flux concentrator or heater is completed by way of a nosepiece, generally identified by the numeral 94. The nosepiece includes a mounting plate portion 95 and a raised portion 96. The mounting plate portion 95 is secured to the coil form 72 by a plurality of suitable fasteners 97. It is to be noted that the mounting plate portion 95 directly engages both the upper surface of the coil form 72 and the upper surface of the core 90. It is to be understood that by resiliently mounting the core 90, it will be held in compressive engagement with the underside of the nosepiece 94.

Reference is next made to FIG. 18, wherein there is illustrated an easy opening end unit 100 having a teardrop dispensing opening 101 formed therein. The opening 101 is initially sealed by a sealing strip or tear strip 102 which is of a conventional construction and preferably is in the form of an aluminum foil-plastics material laminate with the plastics material being of a nature so as to be bondable to the surface of the end unit 100. The tear tape 102 has a first portion 103 which is utilized primarily for the purpose of sealing the opening 101 and has a detachable bond with the end unit 100. The tear tape 102 has an end portion 104 which has a permanent bond with the end unit 100. The opposite end portion of the tear tape 102 is in the form of a grip portion 105 which preferably has a finger receiving opening 106 therein.

The nosepiece 94, as is shown in FIGS. 12–17, is particularly configurated for the purpose of controllably induction heating the end unit 100 in the areas where the tear tape 102 is to be bonded to the end unit 100. To this end, the nosepiece 94 has a longitudinal slot 97 formed therein through both the mounting plate portion and the raised portion 96, the slot 97 preferably terminating within the raised portion 96. Further, the nosepiece 94 is mounted on the coil form 72 with the slot 97 aligned with the slot 92.

It is to be noted that the raised portion 96 includes a shaped portion 107 which corresponds generally in outline to the outline of the opening 101. The raised portion 96 also includes a base portion 108 which is to be aligned with the portion 104 of the tear tape 102. It is to be noted that the base portion 108 also has a slot 110 formed therein, the slot 110 extending transversely of the slot 97 in intersecting relation thereto and further extending entirely through the raised portion 96 and the mounting plate portion 95.

At this time it is pointed out that the raised portion 96 overlies the core 90. It is also pointed out that the part of the longitudinal slot 97 formed in the raised portion 96 has positioned therein a ferrite-containing plate 111 which may be formed of ferrite or ferrite-epoxy. It is also to be understood that disposed in the transverse slot 110 on opposite sides of the slot 97 are ferrite-containing plates 112 of a construction similar to that of the plate 111. The plates 111, 112 extend substantially the full height of the slots 97, 110, as is best shown in FIGS. 16 and 17.

The upper surface of the mounting plate portion 95 on opposite sides of the slot 97 and adjacent the raised portion 96 is recessed as at 113. A fourth ferrite-containing plate 114 is seated in this recess, as is best shown in FIG. 16. It is to be noted that the plate 114 bridges the slot 97.

As is clearly shown in FIGS. 15 and 16, the slots 97 and 110 surrounding the plates 111, 112 and 113, as well as overlying the plate 114, is filled with a clear epoxy 115. Further, overlying the raised portion 96 is a thin coating of aluminum oxide, the coating being identified by the numeral 116.

It is also to be noted at this time that the configurated portion 107 adjacent the base portion 108 has slight recesses in the upper corners thereof, and these recesses are filled with inserts 117 which are formed of a ferrite-containing material such as ferrite-epoxy.

Finally, the nosepiece 94 is provided with a pair of insulating supports 118 which are mounted on opposite sides of the raised portion 96 and are of a circular outline so as to provide an adequate support for the end unit 100. It is to be noted that the upper surfaces of the supports 118 are disposed slightly above the upper surface of the raised portion 96 so as to provide a suitable air gap between the raised portion 96 and the end unit 100 which is to be heated. It is also to be noted that the supports 118, which are secured in place by means of fasteners 120 which extend down into the coil form 72, are undercut as at 121 adjacent the raised portion 96 to provide a suitable air gap.

Returning once again to FIGS. 9 and 10, it will be seen that the opposite elongated sides of the coil form 72 have seated in the upper surfaces thereof plates 122, the plates 122 being formed of ferrite-containing material and being in direct contact with the underside of the nosepiece 94. Similar plates 123 may be recessed within the lower surfaces of the side portions of the coil form 72 and in contact with the base member 77. The purpose of the plates 122, 123 is to reduce the reluctance of a magnetic path between the nosepiece and the core. Ordinarily, the magnetic path has to go from the generally decentral slot all the way down to the bottom of the core which is normally open. With the plates 122, 123, particularly the plates 122, instead of travelling all that distance, the return path for the magnetic field can now come up through the plates. By decreasing the magnetic path link, the overall efficiency of the system is improved. It is to be understood that the nosepiece 94, due to its construction and configuration, serves sufficiently to heat the end unit 100 to effect the required bonding of the plastics material layer of the tear tape 102 to the end unit 100. It is to be understood that the ferrite-containing inserts 117 serve to constrict the current flow toward the vortex of the teardrop shaped opening 101 so that heating is obtained in that part of the end unit 100. Other than that, the shape of the raised portion 96 is similar to that of the teardrop opening, but larger than the teardrop opening.

It is to be understood that the general function of the flux concentrator or heater 70 is the same as that of the flux concentrator or heater 100 and that the nosepiece 94 is particularly adapted to use in conjunction with the end unit 100.

It is also pointed out here that the end unit 100 is preferably formed of aluminum and that the nosepiece 94 is particularly configurated for that purpose.

Although only several preferred embodiments of the flux concentrator and nosepiece have been specifically illustrated and described here, it is to be understood that minor variations may be made therein without departing from the spirit and scope of the invention as defined by the appended claims.

I claim:

1. A flux concentrator for induction heating of preselected areas of metal plates, said flux concentrator comprising a transformer; said transformer comprising a single winding secondary coil form in the form of a thick wall tubular body of a selected height, said body having remote end faces, said body being interrupted by an axial slot extending from the exterior of said body to the interior thereof for the full height of said body, and a multiple winding primary coil wrapped around the exterior of said secondary coil form with the windings of said primary coil bridging said slot; and a nosepiece overlying one of said coil form end faces in electrical conducting relation, said nosepiece being in the form of a generally axially coextensive cover plate for said coil form and having a longitudinal slot therein for the full height thereof, said nosepiece slot being in alignment with said coil form slot with a portion of said nosepiece slot forming an axial extension of said coil form slot, and a shield telescoped over said primary coil for preventing radio-frequency currents from being introduced into adjacent machinery.

2. The flux concentrator of claim 1 together with a coolant coil bonded to walls of said shield.

3. A flux concentrator for induction heating of preselected areas of metal plates, said flux concentrator comprising a transformer; said transformer comprising a single winding secondary coil form in the form of a thick wall tubular body of a selected height, said body being interrupted by an axial slot extending from the exterior of said body to the interior thereof for the full height of said body, and a multiple winding primary coil wrapped around the exterior of said secondary coil form with the windings of said primary coil bridging said slot; and a nosepiece overlying one end of said coil form in electrical conducting relation, said nosepiece having a longitudinal slot therein for the full height thereof, said nosepiece slot being in alignment with said coil form slot with a portion of said nosepiece slot forming an axial extension of said coil form slot, said nosepiece being of a hollow construction, and said coil form having coolant flow passages therein disposed on opposite sides of said axial slot and opening into said nosepiece on opposite sides of said nosepiece longitudinal slot.

4. A flux concentrator for induction heating of preselected areas of metal plates, said flux concentrator comprising a transformer; said transformer comprising a single winding secondary coil form in the form of a thick wall tubular body of a selected height, said body having remote end faces, said body being interrupted by an axial slot extending from the exterior of said body to the interior thereof for the full height of said body, and a multiple winding primary coil wrapped around the exterior of said secondary coil form with the windings of said primary coil bridging said slot; and a nosepiece overlying one of said coil form end faces in electrical conducting relation, said nosepiece having a longitudinal slot therein for the full height thereof, said nosepiece slot being in alignment with said coil form slot with a portion of said nosepiece slot forming an axial extension of said coil form slot, said coil form being substantially filled with a core, and said nosepiece opposing one end of said core, said coil form being generally rectangular in cross-section and including two sides and two ends, said axial slot being formed in one of said two ends, and ferrite-containing pieces being positioned in overlying relation to said coil form sides between said coil form and said nosepiece to reduce the reluctance of magnetic path between said nosepiece and said core.

5. The flux concentrator of claim 4 wherein said coil form and said core are seated on a conductive base, and ferrite-containing pieces are positioned between said coil form sides and said base.

6. A flux concentrator for induction heating of preselected areas of metal plates, said flux concentrator comprising a transformer; said transformer comprising a single winding secondary coil form in the form of a thick wall tubular body of a selected height, said body being interrupted by an axial slot extending from the exterior of said body to the interior thereof for the full height of said body, and a multiple winding primary coil wrapped around the exterior of said secondary coil form with the windings of said primary coil bridging said slot; and a nosepiece overlying one end of said coil form in electrical conducting relation, said nosepiece having a longitudinal slot therein for the full height thereof, said nosepiece slot being in alignment with said coil form slot with a portion of said nosepiece slot forming an axial extension of said coil form slot, said coil form being substantially filled with a core, and said nosepiece opposing one end of said core, said coil form being seated on a base, and a resilient element being positioned between said core and said base to assure contact between said core and said nosepiece.

7. A flux concentrator for induction heating of preselected areas of metal plates, said flux concentrator comprising a transformer; said transformer comprising a single winding secondary coil form in the form of a thick wall tubular body of a selected height, said body being interrupted by an axial slot extending from the exterior of said body to the interior thereof for the full height of said body, and a multiple winding primary coil wrapped around the exterior of said secondary coil form with the windings of said primary coil bridging said slot; and a nosepiece overlying one end of said coil form in electrical conducting relation, said nosepiece having a longitudinal slot therein for the full height thereof, said nosepiece slot being in alignment with said coil form slot with a portion of said nosepiece slot forming an axial extension of said coil form slot, said coil form being substantially filled with a core, and said nosepiece opposing one end of said core, said nosepiece including a mounting plate portion generally corresponding to the cross-section of said coil form and a raised workpiece opposing portion generally overlying said core, and said longitudinal slot being formed in both said mounting plate and said raised portion.

8. The flux concentrator of claim 7 wherein said longitudinal slot terminates in said raised portion.

9. The flux concentrator of claim 7 wherein said raised portion includes a base area, and there being formed in said base area a transverse slot intersecting said longitudinal slot and extending through both said mounting plate portion and said raised portion.

10. The flux concentrator of claim 9 wherein there are ferrite-containing plates in said longitudinal slot and said transverse slot in said raised portion and extending down into said mounting plate portion.

11. The flux concentrator of claim 7 wherein a ferrite-containing plate bridges said longitudinal slot in said mounting plate portion adjacent said raised portion and overlying said coil form axial slot.

12. A nosepiece for a flux concentrator, said nosepiece comprising a mounting place portion and a raised workpiece opposing portion carried by said mounting plate portion with a peripheral part of said mounting plate portion extending entirely around said raised portion, said nosepiece having a longitudinal slot therein opening entirely therethrough, said slot extending from an edge of said mounting plate portion into and through at least a major part of said raised portion.

13. The nosepiece of claim 12 wherein said slot terminates in said raised portion.

14. The nosepiece of claim 12 wherein said raised portion includes a base area, and there being formed in said base area a transverse slot intersecting said longitudinal slot and extending through both said mounting plate portion and said raised portion.

15. The nosepiece of claim 14 wherein there are ferrite-containing plates in said longitudinal slot and said transverse slot in said raised portion and extending down into said mounting plate portion.

16. The nosepiece of claim 12 wherein a ferrite-containing plate bridges said longitudinal slot in said mounting plate portion adjacent said raised portion and overlying said core form axial slot.

17. The nosepiece of claim 12 wherein a ferrite-containing plate is disposed within said slot in said raised portion and extending down into said mounting plate portion.

* * * * *